United States Patent [19]

Pavel et al.

[11] Patent Number: 4,524,815

[45] Date of Patent: Jun. 25, 1985

[54] METHOD OF PRODUCING SEWING MACHINE NEEDLES

[75] Inventors: Klaus Pavel, Eynatten, Belgium; Horst Lange, Aachen, Fed. Rep. of Germany

[73] Assignee: Rhein-Nadel Maschinennadel Gesellschaft mit beschräkter Haftung, Aachen, Fed. Rep. of Germany

[21] Appl. No.: 359,540

[22] Filed: Mar. 18, 1982

[30] Foreign Application Priority Data

| | | | |
|---|---|---|---|
| Mar. 25, 1981 | [DE] | Fed. Rep. of Germany | 3111632 |
| Dec. 21, 1981 | [DE] | Fed. Rep. of Germany | 3150673 |
| Jan. 18, 1982 | [DE] | Fed. Rep. of Germany | 3201285 |
| Feb. 27, 1982 | [DE] | Fed. Rep. of Germany | 3207167 |

[51] Int. Cl.[3] ..... B21G 1/04

[52] U.S. Cl. ..... 163/5; 29/414

[58] Field of Search ..... 163/1-5; 29/414

[56] References Cited

U.S. PATENT DOCUMENTS 1,259,982 3/1918 Heusch ..... 163/1

*Primary Examiner*—Howard N. Goldberg
*Assistant Examiner*—Timothy V. Eley
*Attorney, Agent, or Firm*—Martin A. Farber

[57] ABSTRACT

The present invention relates to a method for the manufacture of sewing machine needles from a cylindrical length of wire by form pressing a length of wire having a diameter which corresponds to the thickness of the needle butt, the wire is reduced to approximately the final cross sectional dimension over at least the length of the needle shank and the shoulder. The thread grooves are pressed in from the curved outer surfaces of the length of wire within the region of the needle shank. The reduction in cross section is effected by pressing opposite cross sections of wire material to form laterally protruding flat burrs. In between the flat burrs are transverse convex curved outer surfaces which lie within the final diameter. This intermediate form of the needle closely resembles its complete final shape. Several needle blanks, in particular two needle blanks, are attached together in the region of their points for simultaneous form pressing. The flat burrs are then removed completely or to the greater extent by a subsequent cutting.

15 Claims, 32 Drawing Figures

1'
1
4
1
5
1
5
6
6
9
9
F 6"
F 9'
A
XIX
XIX
XX
XX
XXI
XXI
XXII
XXII
1'

1
5
8
6
XXIV
10
9'''
Sch
F
9''
9'
9''
L
Ö
XXIII
4
6'
17

FIG.16
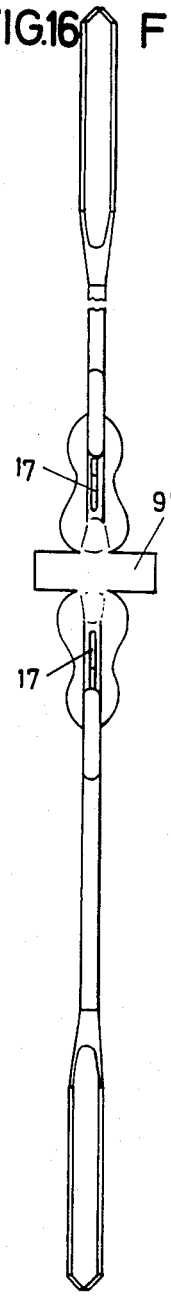
FIG.17
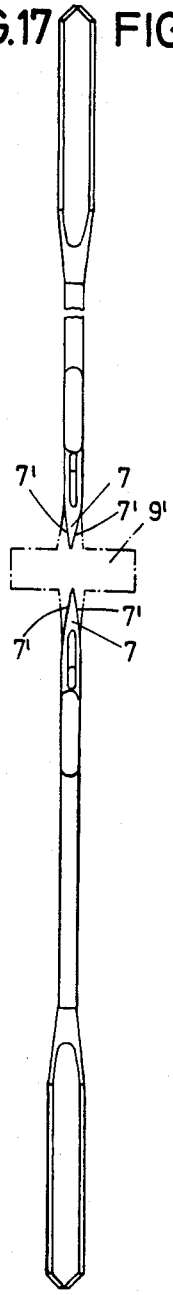
FIG. 18
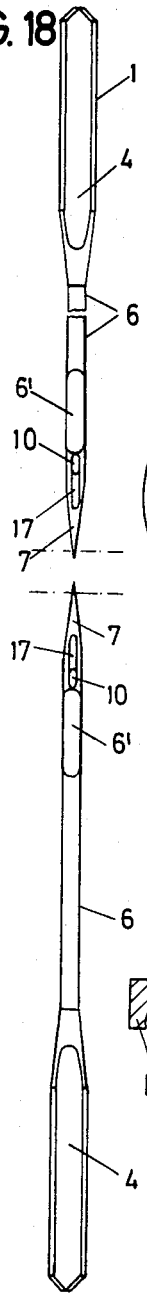
FIG. 19
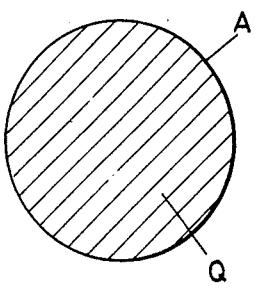
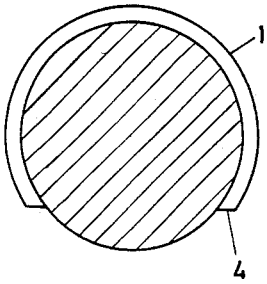
FIG. 20
FIG. 21
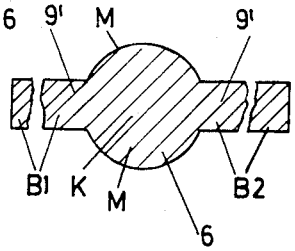

FIG. 29
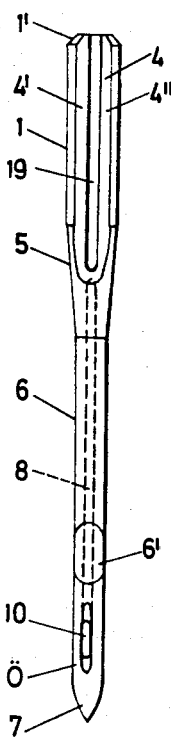
FIG. 28
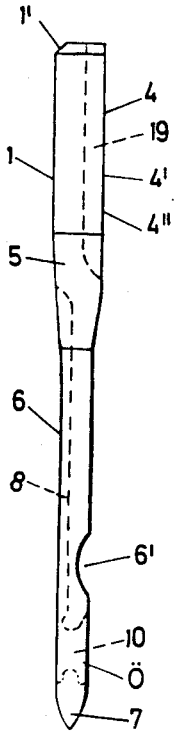
FIG. 30
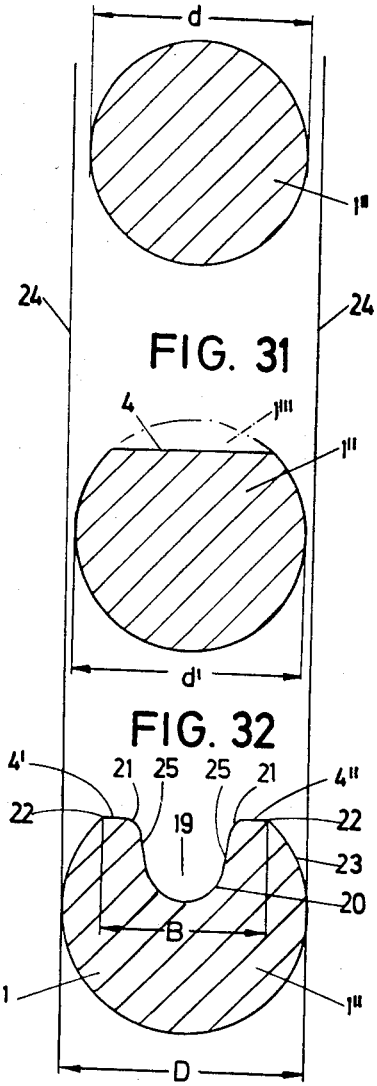
FIG. 31
FIG. 32

METHOD OF PRODUCING SEWING MACHINE NEEDLES

The present invention relates to a method of producing sewing machine needles from a cylindrical length of wire by form pressing in which, starting from a length of wire of a diameter corresponding to the thickness of the needle butt, the length of wire is reduced to approximately the final cross sectional dimension over at least the length of the needle shank and of the shoulder. The thread grooves are then pressed in from the curved outer surfaces of the length of wire within the region of the needle shank.

The reduction in cross section of the blank may be effected, for instance, in a so-called rotary press (West German No. OS 19 52 152). This operation is relatively expensive and considerably increases the cost of a precision part such as a sewing machine needle. A large amount of noise developed as a result of the ram impact is a disturbing factor in production, the ram axially "kneading down" the material of the blank. This cold working over a considerable length has a detrimental effect on the structure of the material. Needle shank and shoulder are then formed by pressing or rolling into an oval cross section and the thread grooves are pressed in from the curved outer surfaces.

A method which replaces the method of reduction by rotary press has been proposed in Swiss Pat. No. 302 627. In that case the length of wire is pressed flat, in the region of the needle shank and shoulder to be formed. In this method, after the flattening of the shank to approximately its cross sectional thickness, plus the pressing of the needle groove and the simultaneous punching, the residue from the flattening is removed by cutting tools. This is done, starting from the pointed end of the blank, in a timeconsuming milling stroke which extends over the entire length of the shank. Although this method uses expensive tools it still has the problem of causing undesirable pressure marks on the small needle body, when such body is controlled and clamped fast in the required manner.

The object of the present invention is to provide an optimum method for the manufacture of needles which is suitable in particular for the production of double needles, using a simpler tool, and only a fraction of the length of stroke of the tool, thus assuring a high degree of economy.

This object is achieved by the process steps indicated in the manner that the reduction in cross section is effected by pressing opposite wire material cross sections into laterally protruding flat burrs, leaving between the laterally protruding flat burrs outer surfaces of a transverse convex curvature defining a final diameter, and removing the flat burrs by a subsequent cutting.

As a result of this development an extremely economical method of manufacturing machine needles is obtained. The method includes a reduction in the cross section of the material partial pre-form pressing of the needle, shank and shoulder takes place on the full cross section of the material with the excess material of the blank being displaced to form oppositely located laterally protruding flat burrs. The entire crude shape of the needle can thus be formed with an extremely short pressing stroke. The material of the blank which is displaced upon the formation of the groove also moves, with the simultaneous pressing of the needle grooves, over the shortest path in the direction towards the flat burrs. The grooving which extends into the eye portion provides an advantageous centering for the front of the tool which stamps out the eye of the needle. The removal of the flat burrs can be effected upon the stamping of the needle eye, i.e. upon the final phase of the stamping. With the use of one and the same pressing stroke it is favorable to effect the cross sectional profiling of the butt also simultaneously with the pressing of the flat burrs. The burrs produced on both side of the axis of the blank can be used in advantageous fashion as a guide and holding surface in the individual process steps. The rather small blank can be easily controlled. A basic body of approximately boat shape in plan view is obtained. The throat between the two diametrically opposite convex outer surfaces and the adjoining wide surface of the burrs also affords a favorable self-centering alignment for the cutting. The cross section of the shank is not supported by the upper and lower shaping dies in the region of the radial direction of flow of the flat burrs so that a free emergence of the excess of material is advantageously provided. In this way stresses in the material are also avoided. Optimal precision of axial stretch is present. A further advantageous development directed at high efficiency and optimum utilization of the material consists in the fact that an intermediate section formed of the flat burrs remains between the points of the needles of a double-needle blank which are arranged spaced apart and facing each other. The intermediate section formed by the flat burrs which are present creates a bridge between the two needles. Furthermore, the region of the points of the two needles is stabilized by this bridge. In addition the region of the points can be dependably grasped, fixed in position and controlled. The intermediate section provides sufficient surface for the provision of an alignment hole for cooperation with an alignment pin provided on the tool. A sequence of steps which is particularly protective of material and tool is present if, after the cutting off of the flat burrs upon the pressing of the eye portion and the pre-formpressing of the point of the needle and the pressing of the needle shaft groove, laterally protruding burr-like shoulders are again pre-pressed in the region of the point. The burr-like shoulders adjoin the intermediate section and a throat is formed after which the blank receives its needle eye. An indentation takes place from this side and the blank is reversed in the press mold to indent the needle eye on the other side. Pressing and cutting of the point and removal of the shoulders together with the intermediate section are then effected. The intermediate section formed by the remaining sections of the flat burrs is also useful for turning the blank. The material of the intermediate section can also be used for forming the point. The heart of the new method of manufacturing needles is an intermediate form which has two opposite convex outer surfaces of a core cross section which are mirror images of each other and are contained approximately within the nominal size of the needle shank, laterally protruding flat burrs whose total cross section of material corresponds approximately to the difference between butt cross section and core cross section extending from said cross section. The pre-formpressing of the needle body which is already imparted its final shape is advantageous not only for the precise cutting off of waste material but also for stabilizing the intermediate product which is obtained from the profiling.

The flat burrs can be used in an advantageous manner to obtain high resistance to bending forces which act on the needle shank. The transition region between shoulder and shank is particularly subject to breaking. Therefore the transition region between the shoulder and needle shank is provided with two diametrically opposite vanes which upon the removal of the flat burrs, remain as burr sections. It is also advantageous for the back of the vanes to be of convex curvature, with the plane of the vanes lying transverse to the direction of passage through the needle eye. In addition the vanes extend over the full length of the shoulder and approximately the same distance over the initial length of the needle shank. The material of the vanes is obtained as a result of the fact that the needle shank is always of smaller cross section. A notch zone present between the frustoconical taper of the shoulder and the shank which may form a point of break even if very obtuse is greatly stabilized by the vanes, which act as stiffening ribs. By their diametral arrangement the vanes also are located sufficiently far away from the flat which may be present on the butt of household sewing machine needles. Furthermore, the vanes can be produced with a sufficient thickness of material. With parallel alignment of the vanes to the said flat they are also not in the way since they do not extend over the flat; the marking of such flats can therefore be effected in all cases without obstruction. By making the back of the vanes formed by the remainders of the flat burr of convex curvature, injury-producing projections and catching of the textile material are also avoided. In addition to the curving of the back, the outer edges and inner corners of the vanes can be transversely rounded. In view of the direction in which a load is applied during sewing it is advantageous for the plane of the vanes to lie transverse to the direction of passage through the needle eye. Optimum stability is obtained in simple fashion since the vanes extend over the entire length of the shoulder and approximately the same distance over the initial length of the needle shank.

The form pressing, however, also offers particular benefits with respect to development of the butt. In a manner advantageous for manufacture, starting from a cross sectional diameter which is smaller than the final diameter of the butt section, the flat is pressed on with an increase of the cross sectional diameter in the remaining region of the circular cross section. A longitudinal groove extending from the flat is then pressed into the butt section in such size that the material displaced upon this form-pressing brings the cross section of curvature of the butt section to its nominal size. In this way a butt contour of proper fit can be produced even if one starts from relatively thinner wire, for instance, for the manufacture of thinner-shanked needles. An additional advantage is the compensating of tolerances. The precision of the fit can be satisfied in the same way as in the case of conventional but more expensively produced needles. It has been found that the reduction in bearing surface which occurs due to the formation of the longitudinal groove does not result in any disadvantage since the remaining surfaces of the flattening retain their maximum width. These remaining surfaces bear equally well. Furthermore, there is no weakening of the body of the needle. The U or V profiling which is now also present in the butt is an additional stabilizing factor. In addition to this, the longitudinal groove produced in the region of the flat does not lie on the same side of the body of the needle as the long thread groove but is axially displaced thereto.

With the above an other objects and advantages in view, the present invention will become more clearly understood in connection with the detailed description of preferred embodiments, when considered with the accompanying drawings, of which:

FIG. 16 shows the needle blank after turning and indenting from the other side;

FIG. 17 shows the needle blank after the cutting of the points;

FIG. 18 shows the needle blank after the pressing of the points and the cutting apart of the two needles;

FIG. 19 is a cross section along the line XIX—XIX of FIG. 8, on a scale larger than that of FIG. 8;

FIG. 20 is a cross section along the line XX—XX of FIG. 9;

FIG. 21 is a cross section along the line XXI—XXI of FIG. 10;

FIG. 28 shows the sewing machine needle with butt grooving in side view, on a larger scale;

FIG. 29 is a side view thereof turned 90°;

FIG. 30 is a cross section through the wire forming the starting material, on a still larger scale;

FIG. 31 is a cross section through the butt section of the sewing machine needle, shown in an intermediate phase, and FIG. 32 is a corresponding section after the pressing of the longitudinal groove into the butt section of the sewing machine needle.

Figure 1:
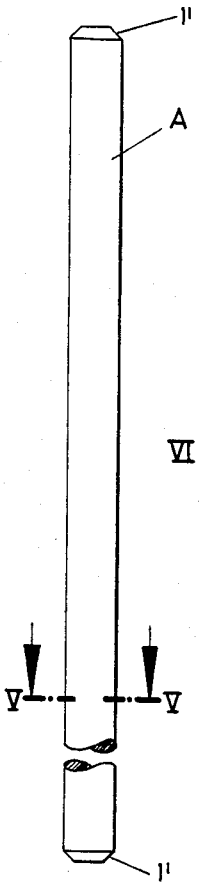
FIG. 1 shows a length of wire forming the starting material having the length of two needles, seen in side view on enlarged scale.
Figure 2:
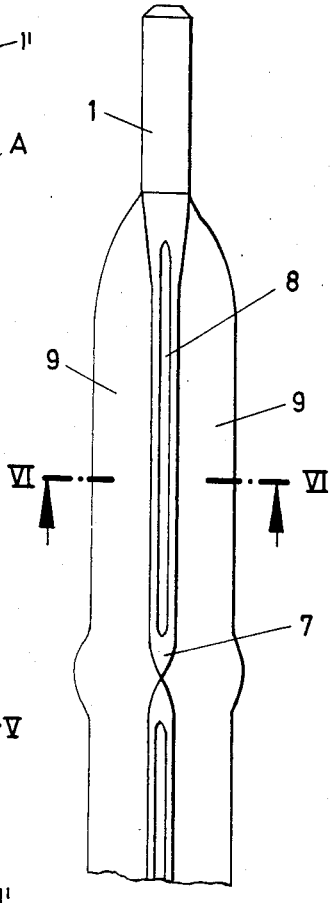
FIG. 2 shows the needle blank after pressing.
Figure 3:
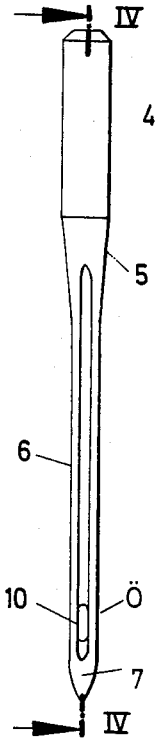
FIG. 3 shows the needle blank after removal of flat burrs and the stamping of a needle eye.
Figure 4:
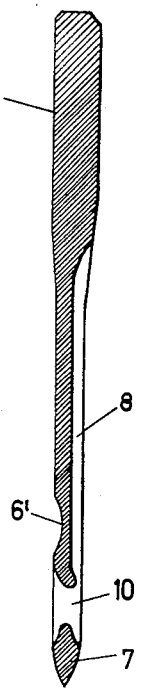
FIG. 4 is a sectional view along the line IV—IV of FIG. 3.
Figure 5:
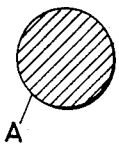
FIG. 5 is a cross section along the line V—V of FIG. 1, on a scale larger than FIG. 1.
Figure 6:
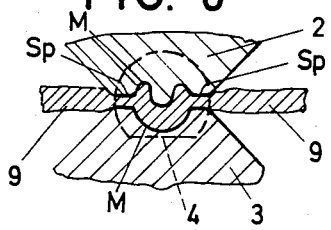
FIG. 6 is a cross section along the line VI—VI of FIG. 2, showing upper and lower dies.
Figure 7:
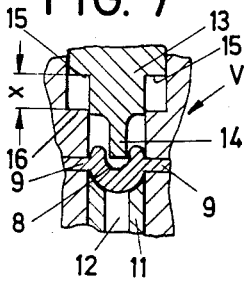
FIG. 7 is a section through a cutting tool before effecting removal of the burr and the stamping of the needle eye.

Referring to the drawings a blank for the manufacture of sewing machine needles is formed by cutting a length of a wire A having a circular cross section. The wire diameter corresponds approximately to the diameter of the cylindrical needle butt 1. Both ends of the length of wire are chamfered at 1'. The total length of this length of wire A corresponds to the material required for the simultaneous production of two sewing machine needles. This length of wire A is introduced into a pressing tool whose upper die is designated 2 and whose lower die is designated 3. The tool is so developed that in addition to the punching of the eye portion Ö the final shape of the needle is produced in one pressing stroke as a result of reduction in cross section. The blank then has in the region of its butt 1 the ordinary flat 4 as well as the frustoconical shoulder 5 that adjoins the flat 4. The flat 4 passes into the needle shank 6 which terminates in a needle point 7. At the butt end of the eye portion the customary throat 6' is also formed.

The needle shank 6 has the shape of a V profile as the result of a simultaneous pressing in of a needle groove 8 which extends from the shoulder 5 into the region of the point 7.

The material of the blank which is displaced as a result of the reduction in cross section and the formation of the groove 8 passes out through a tool slot Sp left on both sides between upper and lower dies 2, 3. The flat burrs formed are designated 9. Their width depends on the volume displaced. In the region of the shoulder 5 less material is displaced than in the region of the point 7.

The flat burrs 9 provide a flat strip-shaped increase in width of the blank which is favorable for the next process step; the surface of the blank is made several times larger and for this reason can be gripped better and introduced better into the next tool station and centered in proper position there. In this tool station the needle eye 10 is stamped. During the stamping the blank is held fast by its flat burrs 9 between the jaws of a separating device V. The needle shank 6 itself lies in a lower ram 11 with a punch opening 12. A corresponding upper ram 13 has a punch stamp 14 that extends into the centering groove 8 which is V-shaped in cross section and rounded at its V vertex. Immediately after the stamping of the needle eye 10 the two flat burrs 9 are simultaneously sheared off by the jaws of the separating device V which are carried along by the upper ram 13 and move downward relative to the stationary lower ram 11. A corresponding delay in time is obtained by the inclusion of a free path x between upper ram 13 and the upper jaw of the separating device. When the two shoulders 15 at both sides of the punch 14 are displaced against the corresponding shoulders 16 of the upper jaw of the separating device such engagement displaces the shearing jaws to remove the flat burrs 9.

The upper ram 13 can be held in raised position by springs (not shown). The springs are not shown in detail.

The rounding of the edges of the needle eye 10 can be effected in the separating device V.

After rounding the edges of the needle eye 10 is accomplished the point 7 is given its final shape either as a rounded point or as tapered point. After finishing the pointing step the customary treatment phases such as heat treatment, polishing, galvanizing and final inspection follow.

Figures 8, 9, 10, 11:
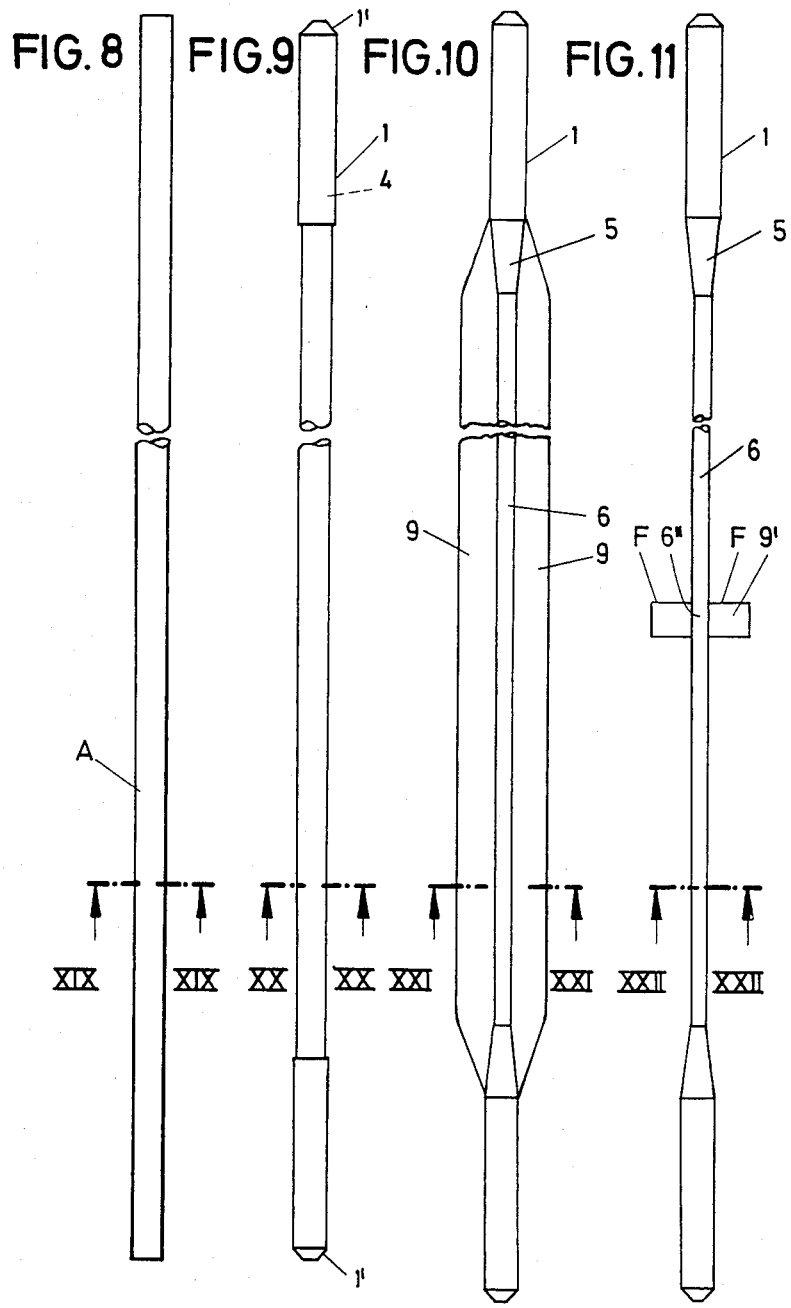
FIG. 8 is a cut length of wire in side view, again of a length which makes it possible to produce two needles simultaneously, with the use of a more subdivided sequence of steps of the method.
FIG. 9 shows the needle blank after a flat-pressing of the butt as a preferred optional measure.
FIG. 10 shows the needle blank after a form pressing of the shoulder and the needle shank of the double needle.
FIG. 11 shows same after a cutting step, leaving a flat-burr residual section between the point ends of the double needles which face each other.

In the embodiment and example of the process which now follows, the formation of two sewing machine needles at the same time is subdivided into a larger number of steps. The butts 1 are left or developed at the free ends of the length of wire A in a first station of a cyclically controlled follow-on tool. In the event of the production of a flat butt the butt-forming end region is duly provided with a flat 4 (FIG. 9). At the same time a marking or designation of origin can be provided by embossing.

From the first station in which the flat 4 is produced the blank passes into the second station (FIG. 10). Here form pressing is again effected and displaced material in the region of the shoulder 5 and the needle shank 6 to be formed passes into the space between upper and lower dies of the form pressing tool (not shown). During pressing there are produced, due to the reduction in cross section which takes place at the two opposite cross sections of the wire material, the laterally protruding flat burrs 9, which protrude freely in the form of vanes from the circular needle-shank and shoulder cross section formed thereby. Reference is had to the sectional view contained in FIG. 21.

The shoulder 5 is of frustoconical shape. The wider base faces the butt 1. FIG. 10 already shows with respect to the shoulder 5 and shank 6 the final contour of the needles to be formed shown in relief. In between the diametrically located flat burrs 9 are transverse convex curved outer surfaces M of the shoulder 5 and the shank 6.

Figure 22:
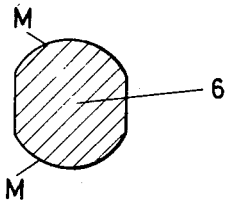
FIG. 22 is a cross section along the line XXII—XXII of FIG. 11.

In the third station (FIG. 11) the blank is now cut. The shank 6 is imparted with the cross sectional shape shown in FIG. 22. The flat, vertical cut surfaces are, upon being pressed in the groove of a die (not shown) are formed into a curved course if this is provided for by the shape (free spaces in the die). The cutting is effected in such a manner that the flat burrs 9 are removed or cut off over a length which corresponds approximately to the final length of the needle shank 6 except for an intermediate section 9' extending over the needle points 7 to be formed. In this way there remain as residual material two diametrically opposite vanes F which extend like the previously formed burrs 9 parallel in space to the flat 4. The remaining intermediate section 9' has the shape of a rectangular plate whose longer side is transverse to the axis of the blank. Its edges 9'' can be used as a stop limitation.

Figure 23:
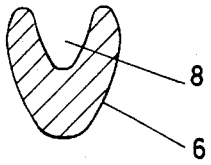
FIG. 23 is a cross section along the line XXIII—XXIII of FIG. 12.

A following fourth station (FIG. 12) accomplishes a form pressing of the long needle groove 8 extending from the shoulder 5 into the region of the point, and a form pressing of the eye portion Ö and the prepressing of the point 7 to be formed. The shank 6 of the sewing machine needle thereby assumes the truncated V-shaped cross section shown in FIG. 23. However, other cross sectional shapes can also be produced, namely round, square, polygonal, etc. The needle groove 8 is symmetrical. The V vertex is convexly rounded as are the ends of the V legs. The bottom of the groove, on the other hand, has a concave rounded portion which corresponds essentially to the cross section of the thread. Upon pressing the eye portion Ö and the pre-form pressing of the needle point, material is again displaced.

Laterally protruding burr-like shoulders 9''' are thereby formed both in the region of the eye-side needle groove 8 and in the point-side end region, said shoulders together having approximately the contour of the sound box of known string instruments, the larger belly section being directly adjacent the remaining intermediate section 9', i.e. directly adjoining it.

The point-forming portion of the form pressing consists of flattening the region of the point so as to form a cutting edge, starting from the general diameter of the shank. Thus a roof-shaped wedge-forming bevel Sch is formed and extends on both sides to the level of the remaining intermediate section 9' which is also further flattened. In this pressing process, therefore, the circular section 6'' (cf. FIGS. 11–13) of the needle shank disappears. As a result, intermediate piece 9' is further widened somewhat. As an aid in centering or an additional aid in alignment with respect to the side edges 9'' the now completely flattened intermediate piece 9' can have an alignment hole L (FIG. 12, dashed-line circle) which cooperates with an alignment pin of the tool.

Figures 12, 13, 14, 15:
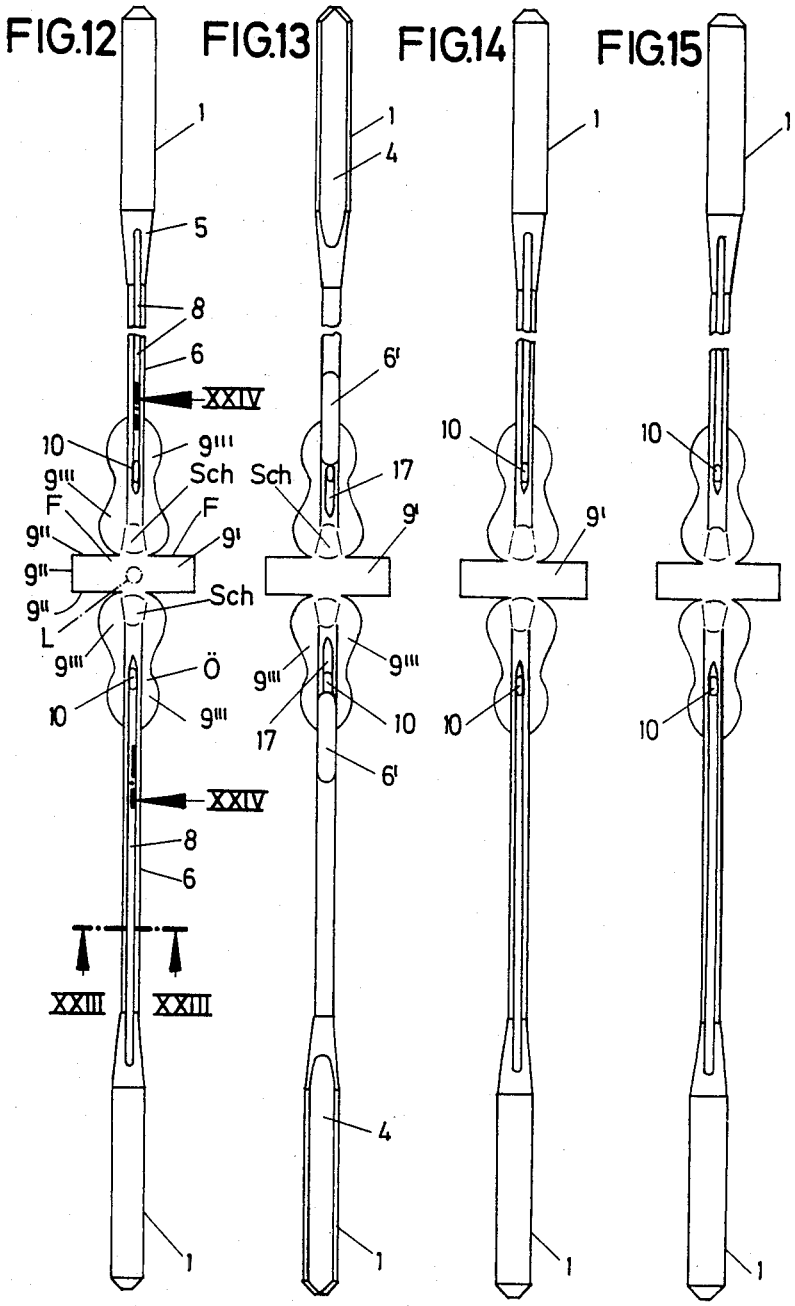
FIG. 12 shows the needle blank after the form-pressing of a long groove together with the eye portion and the prepressing of the point of the needle.
FIG. 13 is a view of the underside thereof showing the throat simultaneously produced thereby.
FIG. 14 shows the needle blank in the same position as in FIG. 12 but after a punching step.
FIG. 15 shows the needle blank after the indentation (rounding of the hole) seen from the one side.
Figure 24:
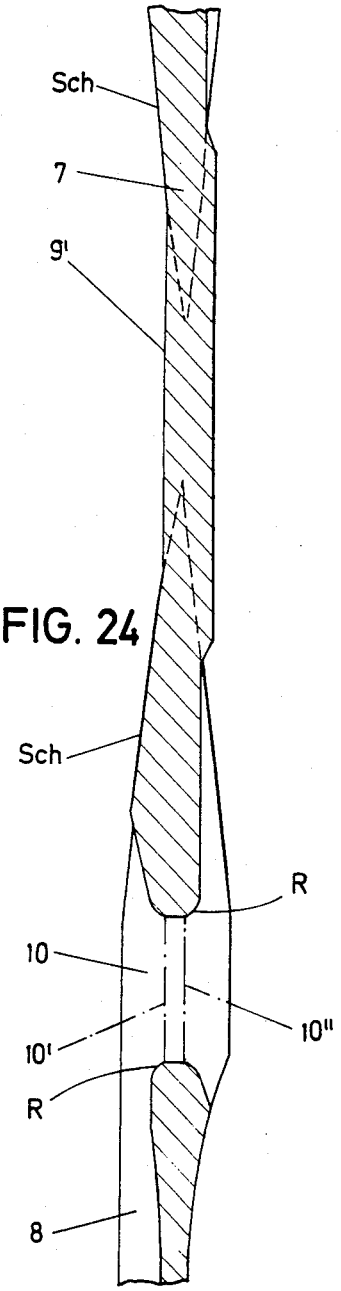
FIG. 24 is a cross section along the line XXIV—XXIV of FIG. 12.

As can be noted on the reversed blank in FIG. 13, the so-called throat 6' has also been simultaneously pressed in the region of the eye portion Ö, said throat extending on the side of the needle shank 6 opposite the needle groove 8. This pressing step also includes the simultaneous formation of the short groove 17. The eye which has not yet been punched, but only pre-embossed, is indicated as needle eye 10 for ease of understanding in FIGS. 12 and 13. The depth of the pre-embossings is shown in FIG. 24 by the lines 10' and 10'' which indicate the bottom of the embossing in this stage.

The punching of the eye 10 is effected at a fifth station of the tool (FIG. 14). Here the eye-forming region is completely pierced. This can take place in extremely accurate fashion since the entire region of the point can be positioned and securely held using the remaining intermediate section 9' of the flat burr 9 and also by the additional shoulders 9'''. In addition to this, the shoulders 9''', which extend transversely to the direction of punching on the side surfaces of the needle shank, form a lateral stabilizing rib which effectively opposes any undesired change in shape in the region of the eye portion.

In the next station, the sixth, the indentation of the eye 10 is effected from one side of the needle (FIG. 15). In the seventh station (FIG. 16) the indentation is effected from the other side. The indentation step also includes a rounding of the edges R of the eye hole which have a sharp burr.

The blank then comes to an eighth station (FIG. 17) used for cutting of the point 7. The point is already flattened on both sides in the plane of the V axis. In the cutting which takes place as indicated in FIG. 17 a similar roof-shape or wedge-like flat portion is cut lying perpendicular thereto. The cut lines are designated 7'. A pyramid point of square contour or cross section is thus obtained. A waste piece shown in FIG. 17, consisting of the intermediate piece 9' and possibly the shoulders 9''', is shown in dot-dash line.

In a following ninth station (FIG. 18) the final individual form-pressing of the point is effected. The region previously taken up by the intermediate section 9' is available for the further shaping of the point. The waste contour of the intermediate section 9' is again indicated in dot-dash lines.

The blank produced—in the double-needle method of manufacture in the manner indicated there are two blanks— is fed for further treatment such as, for instance, heat treatment, polishing, nickel plating, selecting and straightening.

The formation of a residual section of the flat burrs 9 which remains continuously in the region of the needle point 7 provides, in combination with the shoulders 9''' also produced in the method, an advantageous stabilization of what is basically the weakest section of the body of the needle. By clamping this flattened portion during formation of the needle eye 10 an extremely precise manufacture is obtainable, as already stated. Further use of this flattened portion, which serves as an aid in orientation and turning, and as a bridge of material in the region of the facing points of a double needle, furnishes ideal conditions for manufacture of needles in automatic machines having a high output of needle production.

The intermediate product shown in FIGS. 2, 6 and 10, 21 respectively has two outer surfaces M of a core cross section K (for instance shank or shoulder cross section) which are mirror images of each other within the nominal size of the needle shank 6, the laterally protruding flat burrs 9 extending the shank. The total cross sectional material B1 and B2 of the flat burrs 9 corresponds to the difference between the butt cross section Q (FIG. 19) and the core cross section K.

The lateral displacement of the materials can be continued to such a distance that practically 90% of the needle surface—distributed over the top and bottom sides of the blank—is present as the final end shape as a result of one pressing stroke.

Figures 25, 26:
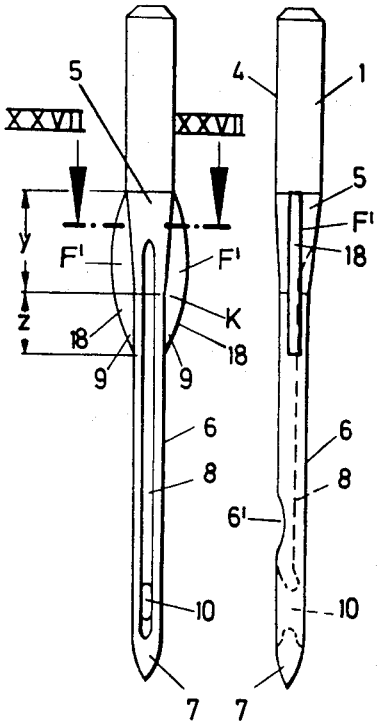
FIG. 25 shows the sewing machine needle after removal of the flat burr except for vane-forming burr sections in the region of the shoulder.
FIG. 26 shows this needle in side view.
Figure 27:
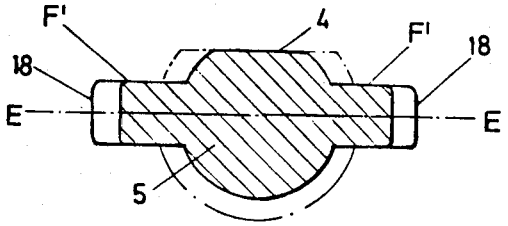
FIG. 27 is a cross section along the line XXVII—XXVII of FIG. 25 on a larger scale.

The flat-burr formation by form pressing as previously described, however, offers various further advantageous possibilities. With reference to FIGS. 25 to 27 two diametrically opposite vanes F' extending in the longitudinal direction of the needle blank are left in the transition region between shoulder 5 and needle shank 6. When removing the flat burrs 9 one proceeds in such a manner that the vanes F' remain as burr sections. The plane E—E of the vanes F' lies parallel to the flat 4 of the butt 1 and transverse to the direction of passage through the needle eye 10.

The vanes F' are cut out in such a manner that while forming a stabilizing rib they extend over the entire length y of the shoulder 5 and approximately the same distance over the initial length z of the needle shank 6. The length z corresponds to approximately twice the diameter of the shank 6.

The bank 18 of the vanes F' is convexly curved in such a manner that the greatest rib width is present in the region of the angular fillet K between needle shank 6 and shoulder 5. The curvature is uniform; the back ends pass in an obtuse angle into the shank 6 and the butt 1 respectively. Regions on which the material can be caught are thereby eliminated. The width or size of surface of the two vanes F' together corresponds approximately to the area of the flat 4. The thickness of the vanes corresponds approximately to half the diameter of the needle shank, but can range down to one-third of that diameter.

The form pressing, either in case of double-needle manufacture or single-needle manufacture, can be advantageously employed also for a special development of the butt. Reference is had to FIGS. 28 to 32. The reference numbers are duly applied without repetitions in the text.

As starting material a length of wire of circular cross section is again used, such as shown on a considerably enlarged scale in FIG. 30. The cross sectional diameter d of the wire is smaller than the final diameter D of the butt section of the final product.

The needle blank described above is first provided with the flat 4 in the region of the butt section 1. The flat 4 is produced by form pressing. As a result of the displacement of the circular-segment-shaped mass of material 1''' into the butt-forming main mass of material 1'' the butt diameter is increased. Referring to FIG. 31, increased diameter of the butt section 1 in this intermediate phase is indicated by d'. The peripheral region remaining, as compared with the flat 4 retains its circular cross sectional shape even though its size is increased. The tool of this intermediate station is correspondingly contoured. Furthermore, the gap between the upper and lower dies is so located that there is no clamping of the needle body takes.

Next, the longitudinal groove 19 extending from the flat 4 is pressed into the butt section 1. The longitudinal groove 19 extends into the shoulder 5 but does not extend over the thread groove 8, which also commences in the shoulder 5. The thread groove 8 lies on the side of the sewing machine needle which is opposite the flat 4.

The mass of material which has now been further displaced by the longitudinal groove 19 passes into the main mass 1'' and upon this form pressing, effects a further increase in the size of the butt diameter until the desired nominal size is reached. The desired nominal size corresponds to the cross sectional diameter D of the butt 1 of the finished sewing machine needle.

The longitudinal groove 19 is symmetrical and furnishes a U or V-shaped profiling of the butt 1. As residual bearing surfaces there remain the end surfaces 4' and 4'' of the U or V arms of the flat 4 which still has its complete surface in the intermediate phase. The flat width B produced in the intermediate phase is retained, as can be noted also from FIG. 32. The bottom 20 of the longitudinal groove is transversely rounded. The transition to the end surfaces 4' and 4'' of the U or V arms takes place also via roundings 21, which, however, are convex.

The edge 22 of the flat passes into the round cross sectional region or cylindrical butt wall 23.

The two parallel orientation lines 24 indicate the course of the deformation in particularly clear manner.

The groove walls 25 diverge upward, as a result of which the tool protrusion which forms the longitudinal groove 19 can be lifted out without jamming. Groove shape and groove depth can be varied with due consideration of the diameter of the starting material and the desired nominal size.

We claim:

1. A method of producing sewing machine needles from a cylindrical length of wire by the steps of form pressing in which, starting from a length of wire having a starting cross section of a diameter substantially corresponding to the thickness of a needle butt, the length of wire is reduced substantially to a thinner final diameter and cross sectional form over at least the entire length of a needle shank including a needle point and the length of a shoulder between the needle butt and the needle shank and grooves are pressed in from curved outer surfaces of the length of wire in the region of the needle shank, wherein the reduction in cross section is effected by pressing the length of wire into laterally protruding flat burrs, leaving between the laterally protruding flat burrs outer surfaces of a transverse convex curvature defining substantially the final diameter of the needle shank and of said needle point and substantially having their said final cross sectional form, and removing the flat burrs by a subsequent cutting.

2. The method as set forth in claim 1, wherein the flat burrs are removed simultaneously.

3. The method as set forth in claim 1, wherein a first portion of the flat burrs is removed in a first cutting step and a second portion of the flat burrs is removed in a second cutting step.

4. The method as set forth in claim 1, wherein the pressing of the grooves and the pressing of the flat burrs are carried out simultaneously.

5. The method as set forth in claim 1, wherein a stamping of a needle eye is carried out simultaneously with the removal of the flat burrs.

6. The method as set forth in claim 1, wherein the length of wire selected is sufficient to form a double needle blank wherein needle point of each of two needles respectively point toward each other and are arranged spaced from each other, and an intermediate section formed by the flat burrs remains between the points of the needles.

7. A method of producing sewing machine needles from a cylindrical length of wire by the steps of form pressing in which, starting from the cylindrical length of wire having a starting cross-section of a diameter substantially corresponding to the thickness of a needle butt, the length of wire is reduced approximately to a final cross sectional form over at least the entire length of a needle shank and by which in the region of the needle shank, a needle groove is pressed in from curved surfaces of the length of wire with production of a flat which projects on the surfaces as flat burrs on both sides, and wherein the pressing simultaneously presses a diameter reduction of the starting cross-section to a final diameter of the final cross sectional form of the needle shank and of a shoulder between the needle butt and the needle shank and to a needle point contour, so as to form the surfaces which have substantially the final diameter of the needle shank and respectively of the shoulder and of the point contour, and removing by stamping the flat which projects on the surfaces as flat burrs on both sides.

8. A method of producing sewing machine needles from a cylindrical length of wire by form pressing in which, starting from a length of wire of a diameter substantially corresponding to the thickness of a needle butt, the length of wire is reduced approximately to a final cross sectional form over at least the length of a needle shank and the length of a shoulder transition from the needle butt to the needle shank and grooves are pressed from a curved outer surface of the length of wire in the region of the needle shank, wherein the reduction in cross section is effected by pressing opposite wire material cross sections into laterally protruding flat burrs, leaving between the laterally protruding flat burrs outer surfaces of a transverse convex curvature defining a final diameter, and removing the flat burrs by a subsequent cutting, upon the pressing of the flat burrs a cross sectional profiling of the butt is pressed at the same time.

9. The method as set forth in claim 8, further comprising starting with a cross sectional diameter of the wire that is smaller than a curved cross section of the final diameter of the needle butt, and pressing a flat of the needle butt onto the wire to increase the cross sectional diameter in the remaining circular cross sectional region of the butt and forming a longitudinal groove starting from the flat by pressing the longitudinal groove into the butt to such a size that the material displaced upon this form pressing brings the curved cross section of the needle butt to its nominal final diameter.

10. A method of producing sewing machine needles from a cylindrical length of wire sufficient to form a double needle blank by form pressing in which, starting from the length of wire of a diameter substantially corresponding to the thickness of a needle butt, the length of wire is reduced approximately to a final cross sectional form over at least the length of needle shanks and the length of shoulder transitions from the needle butt to the needle shanks and needle shank grooves are pressed from curved outer surfaces of the length of wire in the region of the needle shanks, wherein the reduction in cross section is effected by pressing opposite wire material cross sections into laterally protruding flat burrs, leaving between the laterally protruding flat burrs outer surfaces of a transverse convex curvature, and removing portions of the flat burrs by a subsequent cutting having an intermediate section thereof, after the removal of the portions of the flat burrs, and upon pressing of eye portions, pre-form pressing of needle points of two needles, with said points pointing toward each other with said intermediate section therebetween and a pressing of the needle shank grooves, laterally protruding burr-like shoulders ae pressed in regions of the points adjoining the intermediate section and throats are formed in the needle shanks.

11. The method as set forth in claim 10, wherein the eye portions are imparted with respective needle eyes by indenting opposite sides of the needle blank at the eye portions to form indented portions and punching through the indented portions.

12. The method as set forth in claim 11, wherein one side of the needle blank is indented at the eye portions prior to punching the eyes, and the needle blank is turned around to effect an indenting of the opposite side of the needle blank at the eye portions.

13. The method as set forth in claim 11, further comprising the steps of pressing and cutting of the needle points, and removal of the burr-like shoulders together with the intermediate section.

14. A method of producing sewing machine needles from a cylindrical length of wire by form pressing in which, starting from a length of wire of a diameter substantially corresponding to the thickness of a needle butt, the length of wire is reduced approximately to a final cross sectional form over at least the length of a needle shank and the length of a shoulder transition from the needle butt to the needle shank and thread grooves are pressed from a curved outer surface of the length of wire in the region of the needle shank, wherein the reduction in cross section is effected by pressing opposite wire material cross sections into laterally protruding flat burrs, leaving between the laterally protruding flat burrs outer surfaces of a transverse convex curvature defining a final diameter, and removing the flat burrs by a subsequent cutting, two diametrically opposite vanes which remain as burr sections upon the removal of the flat burrs are formed at a transition region between the shoulder and the needle shank.

15. The method as set forth in claim 14, further comprising forming the vanes with a back portion of convex curvature, the vanes being in a plane that lies transverse to a direction of passage through the needle eye, and further forming the vanes to extend over the entire length of the shoulder and approximately an equivalent distance over an initial length of the needle shank.

* * * * *